US010197312B2

(12) United States Patent
Xia

(10) Patent No.: US 10,197,312 B2
(45) Date of Patent: Feb. 5, 2019

(54) HEAT EXCHANGER WITH REDUCED LENGTH DISTRIBUTOR TUBE

(71) Applicant: MAHLE International GmbH, Stuttgart (DE)

(72) Inventor: Yanping Xia, Williamsville, NY (US)

(73) Assignee: MAHLE International GmbH, Stuttgart (DE)

( * ) Notice: Subject to any disclaimer, the term of this patent is extended or adjusted under 35 U.S.C. 154(b) by 353 days.

(21) Appl. No.: 14/468,876

(22) Filed: Aug. 26, 2014

(65) Prior Publication Data

US 2016/0061496 A1 Mar. 3, 2016

(51) Int. Cl.

| | |
|---|---|
| ***F28F 9/02*** | (2006.01) |
| ***F25B 39/00*** | (2006.01) |
| ***F25B 39/02*** | (2006.01) |
| ***F28D 1/053*** | (2006.01) |
| ***F25B 39/04*** | (2006.01) |

(52) U.S. Cl.

CPC ..... *F25B 39/00* (2013.01); *F28D 1/05366* (2013.01); *F28F 9/0265* (2013.01); *F28F 9/0273* (2013.01); *F25B 39/02* (2013.01)

(58) Field of Classification Search

CPC ..... F25B 39/00; F25B 39/02; F25B 39/028; F25B 39/04; F28D 1/05366; F28F 9/0273; F28F 9/0265; F28F 9/0214; F28F 9/0217; F28F 9/028; F28F 9/026; F28F 9/0268; F28F 9/027

USPC ..... 165/173–176

See application file for complete search history.

(56) References Cited

U.S. PATENT DOCUMENTS

| | | | | |
|---|---|---|---|---|
| 1,537,553 | A * | 5/1925 | Rushmore | F28D 1/05333 165/110 |
| 1,684,083 | A | 9/1928 | Bloom | |
| 2,099,186 | A * | 11/1937 | Anderegg | F25B 39/028 165/110 |
| 3,976,128 | A | 8/1976 | Patel et al. | |
| 4,287,945 | A * | 9/1981 | Hessari | F28F 3/08 165/167 |
| 5,651,268 | A | 7/1997 | Aikawa et al. | |
| 5,806,586 | A | 9/1998 | Osthues et al. | |

(Continued)

FOREIGN PATENT DOCUMENTS

| | | | | |
|---|---|---|---|---|
| DE | 102004033099 A1 | 1/2005 | | |
| GB | 2054124 A * | 2/1981 | | F28D 9/0075 |

(Continued)

*Primary Examiner* — Keith M Raymond
*Assistant Examiner* — Miguel A Diaz
(74) *Attorney, Agent, or Firm* — Brinks Gilson & Lione

(57) ABSTRACT

A heat exchanger includes a header, a plurality of tubes, and a distributor. The header is configured to contain refrigerant and define an opening proximate to a termination end of the header. The plurality of tubes extends away from and is fluidicly coupled to the header. The plurality of tubes includes a first group of adjacent tubes characterized as located further away from the opening than a second group of adjacent tubes. The distributor is located within the header and spaced apart from the opening such that a first portion of the refrigerant in the first group of tubes does flow through the distributor, and a second portion of the refrigerant in the first group of tubes does not flow through the distributor.

3 Claims, 2 Drawing Sheets

(56) References Cited

U.S. PATENT DOCUMENTS 5,836,382 A * 11/1998 Dingle ..... F25B 39/028 165/160
5,915,464 A * 6/1999 Kalbacher ..... F28F 9/0212 165/174
5,971,065 A 10/1999 Bertilson et al.
6,161,616 A 12/2000 Haussmann
6,688,138 B2 * 2/2004 DiFlora ..... F28D 1/0535 62/509
7,503,382 B2 * 3/2009 Maezawa ..... F25B 39/00 165/144
7,921,558 B2 4/2011 Beamer et al.
8,065,586 B2 11/2011 Miyoshi et al.
8,235,101 B2 * 8/2012 Taras ..... F25B 13/00 165/101
8,702,608 B2 4/2014 Kim et al.
9,746,255 B2 * 8/2017 Xia ..... F28F 9/0273
2003/0116310 A1 6/2003 Wittmann et al.
2004/0026072 A1 2/2004 Yi et al.
2006/0070399 A1 * 4/2006 Bae ..... F25B 39/02 62/504
2006/0102331 A1 * 5/2006 Taras ..... F28D 1/05366 165/174
2006/0236718 A1 * 10/2006 Lundberg ..... F28D 1/05391 62/515
2007/0039724 A1 * 2/2007 Trumbower ..... F25B 39/028 165/174
2007/0131391 A1 * 6/2007 Ichiyanagi ..... F28D 1/0391 165/110
2007/0144721 A1 * 6/2007 Watanabe ..... F28D 1/05375 165/174
2008/0093051 A1 * 4/2008 Rios ..... F25B 41/067 165/61
2009/0095458 A1 * 4/2009 Lim ..... F28F 9/0224 165/174
2009/0173482 A1 * 7/2009 Beamer ..... F28D 1/05383 165/173
2009/0173483 A1 * 7/2009 Beamer ..... B21D 53/06 165/173
2009/0229805 A1 * 9/2009 Beamer ..... B23P 15/26 165/174
2009/0229980 A1 9/2009 Beamer et al.
2010/0089095 A1 * 4/2010 Macri ..... F25B 39/028 62/525
2010/0089559 A1 * 4/2010 Gorbounov ..... F25B 39/028 165/174
2010/0206535 A1 * 8/2010 Munoz ..... F25B 39/028 165/173
2010/0282454 A1 * 11/2010 Jiang ..... F25B 39/028 165/175
2010/0314090 A1 * 12/2010 Moriya ..... F25B 39/028 165/174
2011/0017438 A1 * 1/2011 Huazhao ..... F25B 39/028 165/174
2011/0240276 A1 * 10/2011 Wintersteen ..... F28D 1/05383 165/173
2011/0315363 A1 * 12/2011 Matter, III ..... F25B 39/028 165/173
2013/0192808 A1 * 8/2013 Liu ..... F25B 39/00 165/174
2013/0199764 A1 * 8/2013 Liu ..... F25B 39/028 165/181
2013/0213627 A1 * 8/2013 Liu ..... F25B 39/00 165/178
2013/0312453 A1 * 11/2013 Jeon ..... F25B 39/028 62/524
2013/0312454 A1 * 11/2013 Jeon ..... F25B 39/028 62/524
2014/0116081 A1 * 5/2014 Ritchie ..... F24F 13/30 62/314
2014/0202673 A1 * 7/2014 Wand ..... F28F 9/0273 165/175
2015/0122470 A1 * 5/2015 Xia ..... F28F 9/0273 165/174
2015/0345843 A1 * 12/2015 Voorhis ..... F28F 9/0273 62/504
2016/0061497 A1 * 3/2016 Chowdhury ..... F25B 39/00 62/515
2016/0076822 A1 * 3/2016 Pettitt ..... B60H 1/00328 165/174
2016/0084548 A1 * 3/2016 Ota ..... F25B 39/028 62/525
2016/0097597 A1 * 4/2016 Ishizaka ..... F25B 39/02 62/525
2016/0116188 A1 * 4/2016 O'Donnell ..... B23P 15/26 126/714
2016/0348982 A1 * 12/2016 Hauer ..... F28F 9/026
2017/0184355 A1 * 6/2017 Wang ..... F28F 9/22

FOREIGN PATENT DOCUMENTS

JP H02217764 A 8/1990
JP H04309766 A 11/1992
JP 2002062082 A * 2/2002
WO 94/14021 A1 6/1994
WO WO 9414021 A1 * 6/1994 ..... F25B 39/028
WO 2009022575 A1 2/2009

* cited by examiner

HEAT EXCHANGER WITH REDUCED LENGTH DISTRIBUTOR TUBE

TECHNICAL FIELD OF INVENTION

This disclosure generally relates to heat exchangers for two-phase refrigerants, and more particularly relates to a distributor within a header of a heat exchanger configured such that a portion of the refrigerant does not flow through the distributor.

BACKGROUND OF INVENTION

Refrigerant evaporators are used in various air conditioning and heat pump systems. When air is being cooled, partially expanded two-phase refrigerant enters the evaporator where it expands to absorb heat from the air. Due to the large mass differences between the liquid and gas phases, momentum and gravity effects can result in an undesirable separation of the phases and cause poor refrigerant distribution which leads to uneven temperature distribution across the evaporator. In order to keep the phases of refrigerant well mixed, the addition of a distributor (e.g. an inlet distributor or an outlet collector) tube within a header has been proposed. However, such distributors undesirably restrict the flow of refrigerant.

SUMMARY OF THE INVENTION

In accordance with one embodiment, a heat exchanger is provided. The heat exchanger includes a header, a plurality of tubes, and a distributor. The header is configured to contain refrigerant and define an opening proximate to a termination end of the header. The plurality of tubes extends away from and is fluidicly coupled to the header. The plurality of tubes includes a first group of adjacent tubes characterized as located further away from the opening than a second group of adjacent tubes. The distributor is located within the header and spaced apart from the opening such that a first portion of the refrigerant in the first group of tubes does flow through the distributor, and a second portion of the refrigerant in the first group of tubes does not flow through the distributor.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
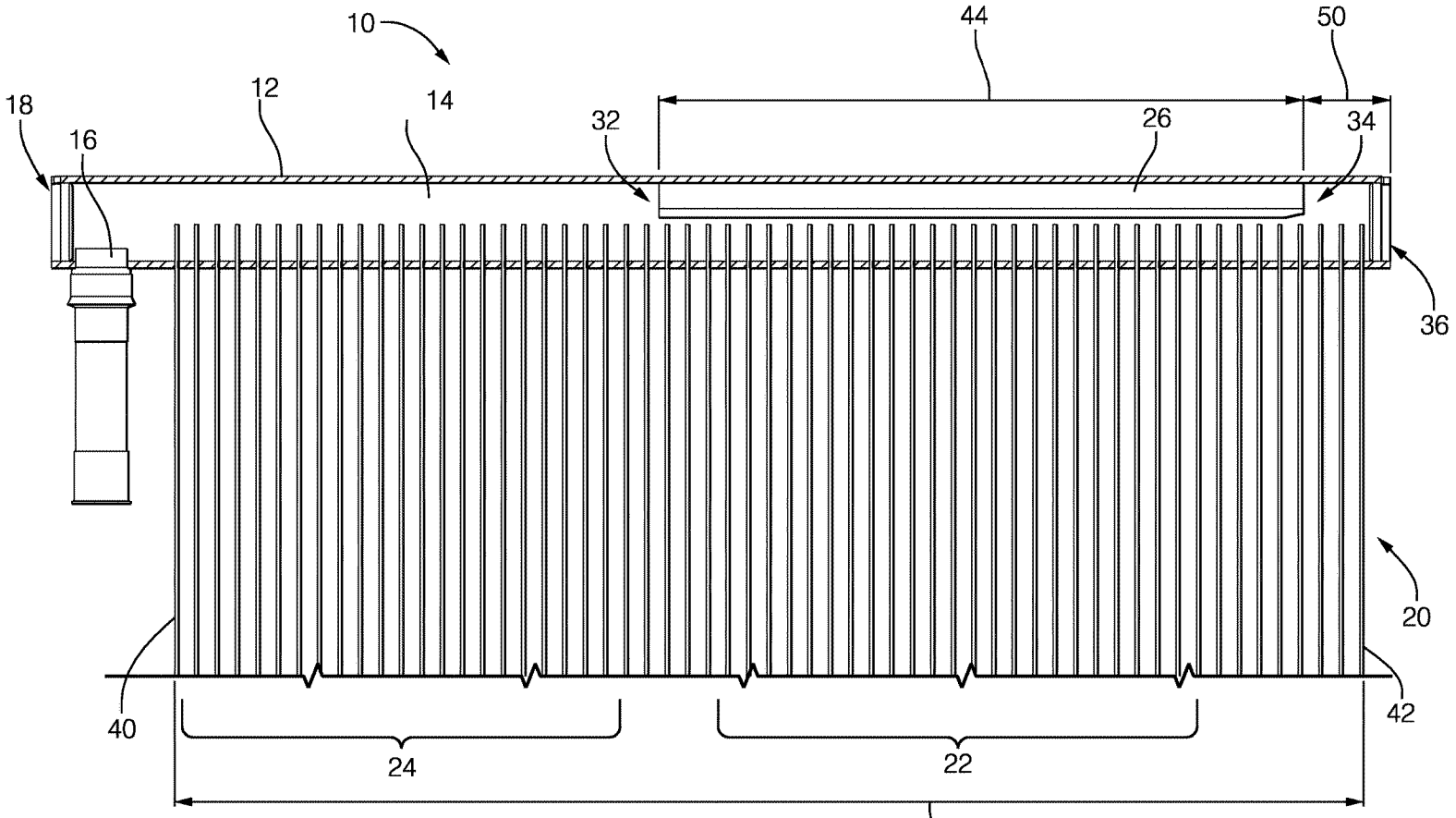
FIG. 1 is a cut-away side view of a heat exchanger in accordance with one embodiment.

FIG. 1 illustrates a non-limiting example of a heat exchanger 10 generally configured for exchanging heat between air passing through the heat exchanger 10 and two-phase refrigerants such as R-134a, HFO-1234yf, or R-410a contained within the heat exchanger 10. The heat exchanger 10 includes a header 12 (sometimes called a manifold) configured to contain refrigerant 14 and define an opening 16 proximate to a termination end 18 of the header 12. While the non-limiting example presented herein is generally directed to an outlet header located at the top of an evaporator used to add heat to the refrigerant 14, it is recognized that the teachings presented herein are applicable to an inlet header located at the bottom of an evaporator. It is also recognized that the teachings are also applicable to the top and bottom headers of a condenser used to remove heat from refrigerant. If the heat exchanger 10 is being used as an evaporator, the opening 16 may be characterized as an outlet for the heat exchanger 10. If the heat exchanger 10 is being used as a condenser, the opening 16 may be characterized as an inlet for the heat exchanger 10.

The heat exchanger 10 includes a plurality of tubes 20 extending away from and fluidicly coupled to the header 12. For the purpose of explanation, each of the plurality of tubes 20 are identified as being members of various groups of tubes which include a first group 22 of adjacent tubes and a second group 24 of adjacent tubes. As used herein, a group of adjacent tubes means that all the tubes in a group are adjacent to other tubes within the group. In other words, there are no tubes that are not members of the group interposed between tubes that are members of the group. In this example, the first group 22 is characterized as located further away from the opening 16 than a second group 24.

The heat exchanger 10 also includes a distributor 26 located within the header 12. Distributor tubes (distributors) have been proposed to improve refrigerant distribution; see distributors used on plate type evaporators in US2004/0026072, US806586, U.S. Pat. No. 3,976,128, U.S. Pat. No. 5,651,268, U.S. Pat. No. 5,971,065, WO94/14021, US2003/0116310, JP2002062082, J04309766, JP02217764, 8702608, and U.S. Pat. No. 6,161,616; and tube and center evaporators with one piece manifold tanks in US2009/073483, US2009/0229805, and US2009/0173482. The basic tube-in-tube concept for evaporator headers was disclosed in U.S. Pat. No. 1,684,083 issued Sep. 11, 1928. Residential indoor, outdoor, and commercial refrigeration heat exchangers typically have headers that are three to eight times longer than typical automotive evaporator headers. This dramatically increases the length along the header longitudinal axis where the two-phase refrigerant needs to remain mixed, i.e.—does not allow the liquid and gas portions to separate.

Distributors are used to obtain better refrigerant distribution. Distributors can be used as inlet (distributor) or outlet (collector) devices. Inlet distributors are intended to deliver partially expanded two-phase refrigerant uniformly along their length. In practice their capacity is limited by the pressure drop created by the cross sectional area of the distributor. It has been observed that the pressure drop caused by an inlet distributor affects heat exchanger performance by limiting refrigerant flow down the header. Outlet distributors are intended to collect fully expanded gaseous refrigerant uniformly along their length. Since the refrigerant is typically a gas in the outlet header, refrigerant velocity and the corresponding pressure drop can be higher than in the inlet header. Outlet pressure drop reduces performance by constraining refrigerant flow, inducing refrigerant flow mal-distribution, and raising the coil inlet pressure and temperature since the outlet condition is typically controlled.

Figure 2:
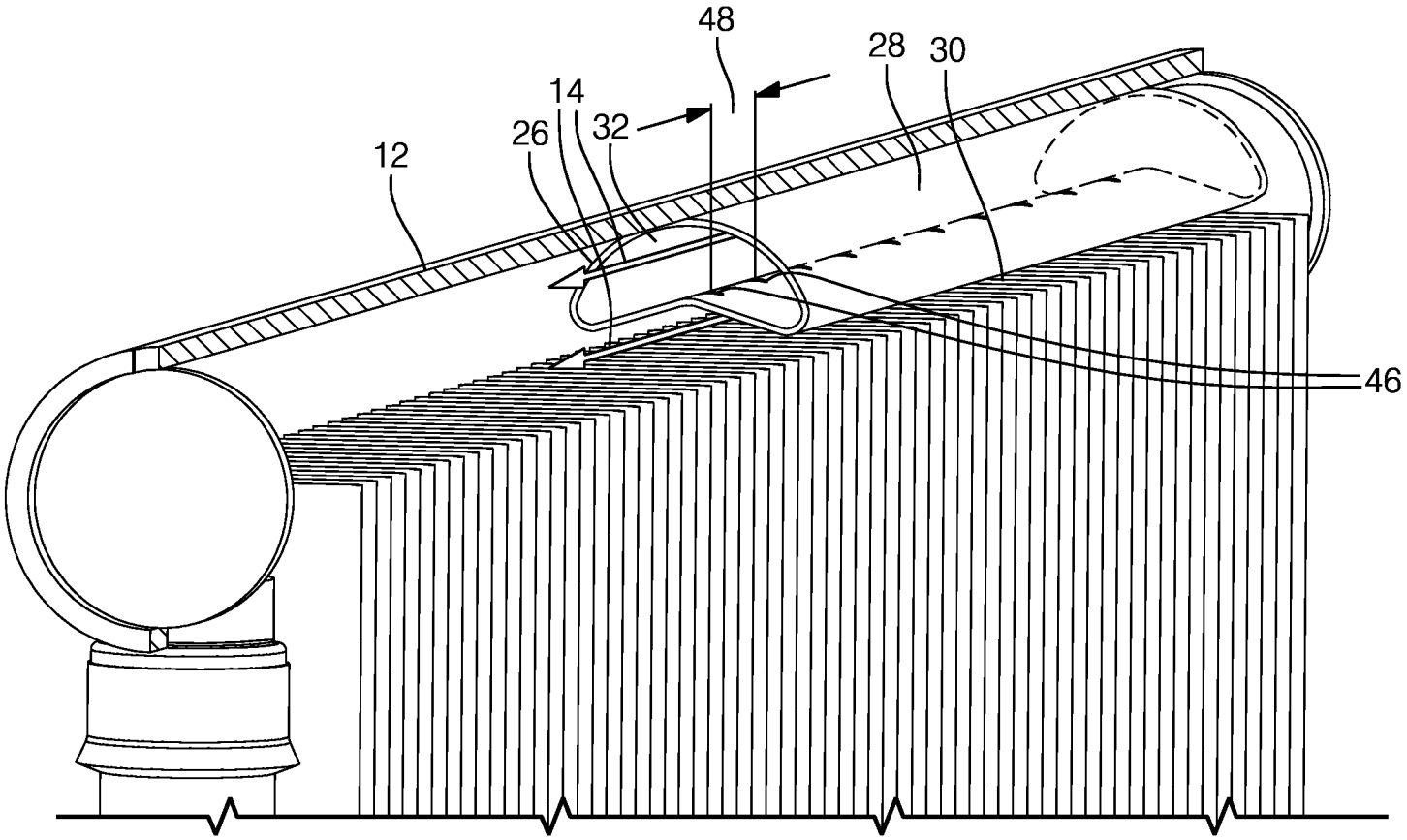
FIG. 2 is a close-up isometric view of the heat exchanger of FIG. 1 in accordance with one embodiment.

FIG. 2 further illustrates details of the distributor 26 described herein. The distributor 26 is also located within the header 12, but is distinguished from the prior examples listed above as the distributor 26 is spaced apart from the opening 16 such that a first portion 28 of the refrigerant 14 in the first group 22 of the tubes 20 does flow through the distributor 26, and a second portion 30 of the refrigerant 14 in the first group 22 of the tubes 20 does not flow through the distributor 26. Prior examples of distributors are directly coupled to the opening 16 such that the entire quantity of refrigerant 14 passes through the prior art distributor.

By way of further explanation and not limitation, FIG. 2 illustrates the flow paths for the refrigerant 14 to flow out of the tubes 20 and towards the opening 16 at the left end of the header 12. The refrigerant 14 flowing out of the second group 24 will collect into the open area of the header, and then flow toward the opening 16. However, the refrigerant out of the first group 22 either flows through the narrow space beneath the distributor 26 and the ends of the first group 22, or flows into the distributor via holes 46, and then out of the distributor through the open end 32 and toward the exit (the opening 16). As such, the distributor 26 increases the flow resistance for the right half of the core tubes (the first group 22) and thus reduces the flow rate. The amount of resistance can be easily varied by varying the size of the holes 46, to provide same flow rate of refrigerant as the left half of the core (the second group 24).

As described above, the distributor 26 defines an open end 32 oriented toward the termination end 18. In this non-limiting example, the distributor 26 also defines a closed end 34 oriented toward an opposite end 36 of the header 12. A tube length 44 of the distributor 26 is generally determined by a distance between the open end 32 and the closed end 34. If a functional width 38 of the heat exchanger 10 is defined by a distance between a first tube 40 and a last tube 42, then a preferable value for the tube length 44 of the distributor 26 is between 25% and 75% of the functional width 38. If the tube length is too short, there may be an undesirable mal-distribution of temperature across the heat-exchanger. If the tube length 44 is too long, there may be an undesirable increase in restriction there by reducing the overall flow rate of the heat exchanger which reduces the amount of heat being exchanged.

As noted above, the distributor 26 defines a plurality of holes 46 arranged longitudinally along the distributor 26. In this non-limiting example, the holes 46 are arranged a single row and oriented toward the ends of the tubes. Alternatively the holes 46 could be arranged in various patterns in order to optimize the temperature distribution across the heat exchanger 10 at various refrigerant flow rates. In this example the holes are spaced apart by a separation distance 48. The closed end 34 of the distributor 26 (the end that is oriented toward the opposite end 36 of the header 12) is preferably spaced apart from the opposite end 36 by an offset distance 50 that is less than the separation distance 48. Alternatively, the closed end 34 could be closed by sealing the end of the distributor 26 directly to the opposite end 36 of the header 12. Having the closed end 34 spaced apart from the opposite end 36 is advantageous because it avoids having to critically align and seal an open end to the opposite end 36.

A prior heat exchanger design has a header that is about 610 mm long and 40 mm in diameter. The distributor in this prior design is about 575 mm and the outlet end of this distributor is coupled to the opening (similar to the opening 16) in such a way that all refrigerant passing into the opening passes through this distributor. Testing has shown that by omitting the left half of the collector, i.e. a collector runs only the right half of header length as illustrated in FIGS. 1 and 2, overall performance of the heat exchanger 10 is improved over the prior design. Furthermore, manufacturing of the heat exchanger was simplified as the distributor 26 can use a much simpler hole pattern as all of the holes can be the same size, and with the open end 32 as illustrated the need for a complicated expanded cross-section at the exit end to couple to the opening is eliminated. By eliminating the direct coupling to the opening 16, a thinner gage material can be used to form the distributor 26.

If the distributor tube length is 280 mm and the distributor 26 is arranged in the header 12 as shown in FIGS. 1 and 2, a half collector design is formed. Testing has shown that the half collector design provides similar refrigerant distribution to a full length distributor with a 575 mm tube length, but improves evaporator performance by reducing outlet manifold pressure drop. At high load (about 350 kg/hour) and low load (about 275 kg/hour) respectively, the half collector design reduces the outlet manifold pressure drop by 64% & 59%, which increases mass flow rate and thereby improves heat transfer performance by 0.7% & 2.2%.

Accordingly, a heat exchanger 10 with an improved performance provide by the distributor 26 described herein is provided. The distributor 26 improves refrigerant distribution, heat transfer performance, and outlet air temperature distribution in heat exchangers used as evaporators in residential and commercial air conditioning applications. This improvement provides an outlet collector design that evenly distributes refrigerant in both evaporator and condenser mode, improves evaporator mode performance by reducing refrigerant pressure drop, and reduces material cost.

While this invention has been described in terms of the preferred embodiments thereof, it is not intended to be so limited, but rather only to the extent set forth in the claims that follow.

I claim:

1. A heat exchanger comprising:

a header configured to contain refrigerant, the header configured to be a top header forming either an outlet header of an evaporator or an inlet header of a condenser, the header defining an axis and including an opening proximate to a termination end of the header;

a plurality of tubes extending radially away from and fluidically coupled to the header, wherein the plurality of tubes includes a first group of adjacent tubes located axially further away from the opening than a second group of adjacent tubes; and a distributor located within the header and spaced apart from the opening and from the termination end, the header having an open space axially between the termination end and the distributor, wherein the second group of adjacent tubes has tube ends extending into the open space and the first group of adjacent tubes has tube ends facing the distributor such that a first portion of the refrigerant in the first group of adjacent tubes does flow through the distributor, and a second portion of the refrigerant in the first group of adjacent tubes does not flow through the distributor, wherein all of the tube ends of both the first group of adjacent tubes and the second group of adjacent tubes are in fluid communication with one another via the header outside of the distributor tube, wherein the distributor has an open end oriented toward the termination end and a closed end oriented toward an opposite end of the header, wherein the distributor defines a plurality of holes, wherein all of the holes defined by the distributor are oriented toward the tube ends of the first group of adjacent tubes and arranged in a single row longitudinally along the distributor, wherein adjacent ones of the holes are spaced apart by a separation distance, and the closed end of the distributor that is oriented toward the opposite end of the header is spaced apart from the opposite end by an offset distance that is less than the separation distance.

2. The heat exchanger in accordance with claim 1, wherein a functional width of the heat exchanger is defined by a distance between a first tube and a last tube, and a tube length of the distributor is between 25% and 75% of the functional width.

3. The heat exchanger in accordance with claim 1, wherein the distributor is a distributor tube disposed within the header.

* * * * *